US005125660A

United States Patent [19]

Stahl

[11] Patent Number: 5,125,660

[45] Date of Patent: Jun. 30, 1992

[54] SIX-SIDED GAME DICE WITH PLAYING CARD INDICIA

[76] Inventor: Frederick Stahl, Simrockallee, 5300 Bonn 2, Fed. Rep. of Germany

[21] Appl. No.: 796,628

[22] Filed: Nov. 22, 1991

[51] Int. Cl.[5] ..... A63F 9/04

[52] U.S. Cl. ..... 273/146

[58] Field of Search ..... 273/146, 147

[56] References Cited

U.S. PATENT DOCUMENTS

| | | | |
|---|---|---|---|
| 25,701 | 6/1896 | Patton | 273/146 |
| 614,524 | 11/1898 | Yardley | 273/146 |
| 645,112 | 3/1900 | Mapes | 273/146 |
| 809,293 | 1/1906 | Friedenthal | 273/146 |
| 1,419,056 | 6/1922 | Kaufman | 273/146 |
| 1,481,628 | 1/1924 | Souza | 273/146 |
| 3,608,905 | 9/1971 | Edison | 273/146 |
| 4,258,919 | 3/1981 | Martelli | 273/146 |
| 4,436,306 | 3/1984 | Sanders | 273/146 |
| 4,989,875 | 2/1991 | Capy | 273/146 |

FOREIGN PATENT DOCUMENTS

| | | | |
|---|---|---|---|
| 648549 | 12/1928 | France | 273/146 |

OTHER PUBLICATIONS

Playthings, "Poker Dice", May 1969, p. 30.

*Primary Examiner*—Benjamin Layno

[57] ABSTRACT

Five cubical dice marked with suit and numerical attributes, representative of playing card indicia. Each unique combination of a suit and a numerical attribute is marked on no more than one face of the five dice. The suit and numerical attributes are distributed among the five dice in a way that permits throwing poker hands known as a striaght flushes and fours of a kind, as well as pairs, threes of a kind, full houses, flushes and straights. Any straight flush or four of a kind that can be assembled from the aggregate of suited playing cards represented on the faces of the dice can be thrown with the dice.

2 Claims, 1 Drawing Sheet

PERSPECTIVE VIEW OF DICE

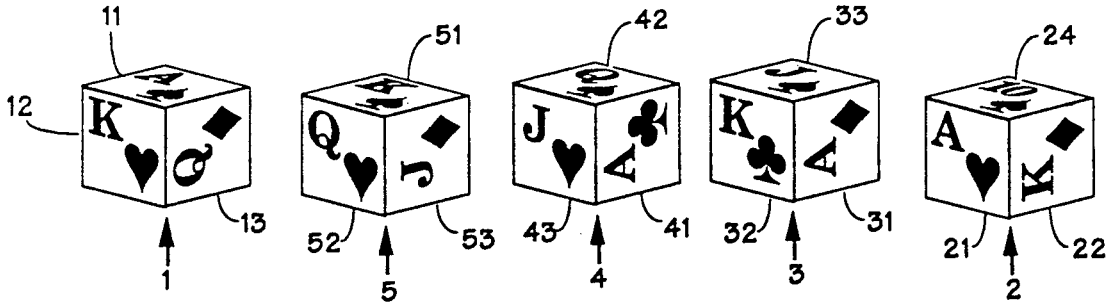
Fig. 1 PERSPECTIVE VIEW OF DICE
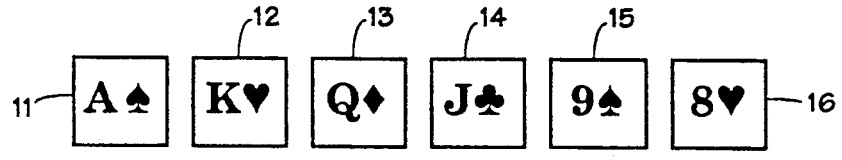
Fig 2A MARKINGS ON FACES OF DIE 1
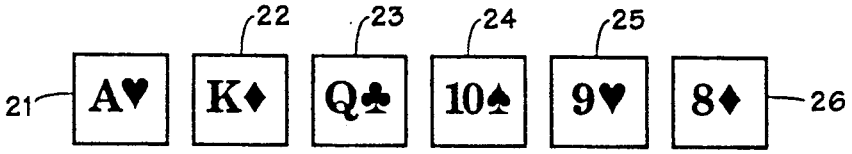
Fig 2B MARKINGS ON FACES OF DIE 2
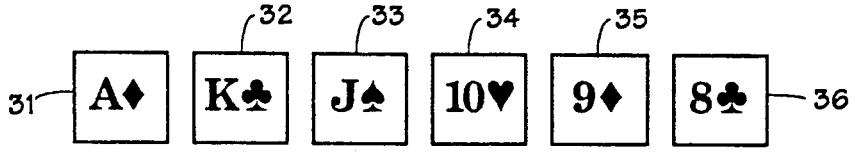
Fig 2C MARKINGS ON FACES OF DIE 3
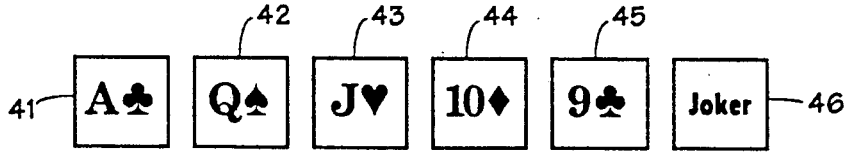
Fig 2D MARKINGS ON FACES OF DIE 4
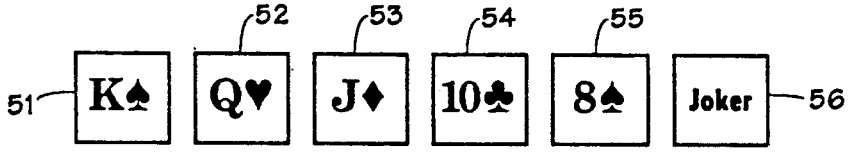
Fig 2E MARKINGS ON FACES OF DIE 5
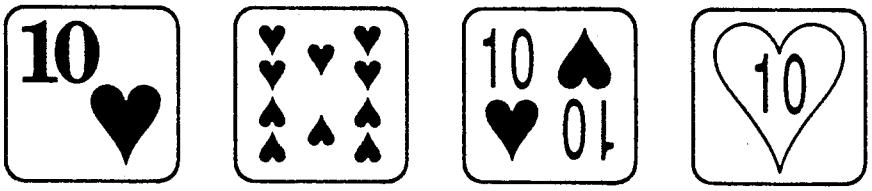
Fig. 3 SOME ALTERNATIVE MARKING STYLES

SIX-SIDED GAME DICE WITH PLAYING CARD INDICIA

FIELD OF INVENTION

This invention relates to five six-sided dice, specifically to such dice marked with numerical and suit attributes as seen on playing cards so that the dice can be used in games where the markings showing on the upper surfaces of the dice after being thrown are interpreted as hands of poker.

BACKGROUND

Dice have long been used to simulate the play of poker. It is well known that people commonly use several ordinary cubical dice, each marked with one to six points, to throw representations of poker hands. Since such dice have no suit attribute markings, the variety of kinds of hands that can be obtained is limited. Only hands containing a pair, two pair, three of a kind, full house, four of a kind, five of a kind, or a straight can be rolled.

A major innovation in dice for poker-like games was the use of markings similar to those on playing cards. One design that became very popular uses a cubical die that shows nine through ace on its faces. The ace is marked with a single suit symbol, often a spade. The ten is marked using a set of ten symbols of a suit. The nine is marked analogously. The remaining three faces bear designs reminiscent of those found on king, queen and jack playing cards but have no markings indicating suit. Such dice are often sold in sets of five. All dice in a set are marked identically.

Despite the fact that such dice can show no more hands than can common spotted dice, they have gained enormous popularity around the world. Many have been manufactured for over a century, and they are still to be found offered for sale. They have become classic. To many people, the term "poker dice" means such dice. In fact, The Random House Dictionary of the English Language [Unabridged Edition, copyright 1966, Random House, Inc., New York] defines "poker dice" as such. In the following paragraphs, these dice are called "classical poker dice" to distinguish them from other kinds of dice bearing playing card indicia.

Classical poker dice serve to characterize much of the prior art in the U.S. patent literature dealing with poker dice. Perhaps more importantly, classical poker dice have served as a starting point for invention. Since 1898, dice with card indicia patented in the U.S. were intended to improve the variety of kinds of poker hands by getting more and better representations of playing cards onto dice. Inventors have used dice with more than six sides and have added suit attribute markings.

For example, U.S. Pat. No. 614,524 to Yardley (1898) disclosed five decahedral (10-sided) dice bearing full likenesses of playing cards. U.S. Pat. No. 645,112 to Mapes (1900) disclosed five dodecahedral (12-sided) dice, each face of which shows both numerical and suit attribute markings. U.S. Pat. No. 809,293 issued to Friedenthal (1906) disclosed five decahedral dice with suit and numerical attribute markings.

Another shortcoming of classical poker dice is that they do not yield straight flushes.

It is easy to design even cubical dice with which one can throw straight flushes but only straight flushes. Simply place the four aces of the four suits on faces of one die; the four kings on faces of a second die, the four queens on a third die, the four jacks on a fourth die and the four tens on the fifth and last die. No matter which card indicia appear on the unspecified two faces of each die, one cannot throw hands containing four aces, four kings, four queens, four jacks or four tens. The essence of a good design for dice with playing card indicia is that both straight flushes and fours of a kind can be thrown with them.

Although this analysis and subsequent objects and description focus on the capability of dice to yield fours of a kind and straight flushes, that is not to ignore triples and pairs. The capability to throw four of a kind with dice is the most demanding level of performance of several closely related capabilities, including throwing a full house, three of a kind, two pairs, and a pair. Generally, if a set of poker dice can yield fours of a kind when thrown, it will also yield poker hands containing triples and pairs.

Interestingly, Mapes in 1900 must have recognized the value of being able to throw both fours of a kind and straight flushes because the markings on his dodecahedral dice permit both kinds of hands. But the text of his patent is silent on this feature.

In later years, inventors explicity recognized the benefits of enabling players to roll both straight flushes and fours of a kind and used dice with eight or more sides to achieve that objective. U.S. Pat. No. 3,608,905 to Edison (1971) disclosed five dodecahedral dice marked with suit and numerical attributes and claims straight flushes. U.S. Pat. No. 4,989,875 to Capy (1991) discloses octahedral (8-sided) dice marked with suit and numerical attributes in a manner to allow throwing straight flushes. In neither of these two patents, however, does the inventor specifically recognize the capability to throw fours of a kind with the same dice that allow straight flushes.

Some inventions having to do with dice with playing card indicia seem to take a step backwards. U.S. Pat. No. 1,419,056 to Kaufman (1922) disclosed a die in the shape of a fourteen-sided polyhedron, marked only with numerical attributes and lacking suit attribute markings. Several such dice could used to simulate playing poker with cards. But poker hands depending on suits for definition can not be rolled with Kaufman's dice. This invention did not therefore extend the variety of kinds poker hands that can be rolled beyond those available with the classical poker dice. It merely increased the number of numerical attributes marked on the dice.

Another approach to solving explicity the problem of being able to roll both straight flushes and fours of a kind is to change the game. U.S. Pat. No. 4,436,306 to Sanders (1984) discloses markings for eight numerical attributes combined with five suit attributes distributed over the faces of five octahedral dice. Such dice can only be used for some derivatives of the game of poker wherein the rules have been adjusted to recognize five suits. The inability of such dice to match popular understandings of the game of poker is obviously a commercial disadvantage.

Although clever in concept, dice with eight, ten, twelve, or fourteen sides bearing playing cards indicia have historically never achieved the popularity of classic poker dice despite the obvious shortcomings of the latter. Perhaps it is the unaccustomed appearance of the higher order polyhedra, or the feel of such unfamiliar shapes in a player's hand. Some patent literature—for example, U.S. Pat. No. 4,989,875 to Capy (1991)—teaches that six-sided dice have superior rolling performance that guarantees a certain level of credible randomness. The regular octahedra and decahedra have angles too pronounced to achieve a roll in a manner that overcomes the characteristics of the throw.

Another disadvantage of dice with more than six sides is that they produce proportionately fewer exciting hands and are therefore less entertaining. The following table, calculated ignoring jokers, shows the fall off in entertainment value as the number of sides is increased.

| Identification of Dice | Number of Sides | Entertainment Value = Probability of Throwing Two Pair Or Better |
|---|---|---|
| Classical Poker Dice | 6 | 48.0 percent |
| U.S. Pat. No. 4,989,875 to Capy (1991) | 8 | 18.5 percent |
| U.S. Pat. No. 809,293 to Friedenthal (1906) | 10 | 11.4 percent |
| U.S. Pat. No. 645,112 to Mapes (1900) | 12 | 6.9 percent |

Whatever the reason, the vast majority of people over the decades seem to clearly prefer cubical poker dice. All prior art disclosed in U.S. patents, save one instance, are defective in this manner. That is, they involve dice with more than six faces.

The one exception is U.S. Pat. No. 4,258,919 to Martelli (1981). Recognizing the restrictions on the kinds of hands that can be thrown with six-sided classical poker dice, this patent discloses creation of a fifth suit to enrich the yield of six-sided dice. Markings for ace through nine with each of five suits are distributed across five six-sided dice in a way to permit both straight flushes and fours of a kind to be thrown. As with Sanders dice, this method is a commercial disadvantage because the concept of five suits departs significantly from the familiar character of poker.

In summary, all prior disclosed art involves dice which are unsatisfactory because they have more than six sides, do not permit throwing both straight flushes and fours of a kind or depart from popular notions of poker through the introduction of additional suits.

OBJECTS AND ADVANTAGES

The objects and advantages of the present invention are:

(a) to provide a set of five dice, faces of which are marked with unique combinations of suit and numerical attributes to provide a rich variety of kinds of poker hands, (b) to provide a set of five dice so marked that when thrown, the set is capable of yielding every straight flush possible from the suit and numerical attributes marked on the faces of the dice (c) to provide a set of five dice so marked that when thrown, the set is capable of yielding every set of four die faces marked with the same numerical attribute, that is, four of a kind, (d) to accomplish the above with a set of five individually cubical dice, an elegantly simple, familiar, popular and economically manufactured shape, and (e) to accomplish the above with no more than four suit attributes.

Still further objects and advantages will become apparent from a consideration of the ensuing description and drawing.

DRAWING FIGURES

FIG. 1 shows a perspective view of the preferred embodiment of the five dice.

FIG. 2A through FIG. 2E show the arrangement of numerical and suit attribute markings on five dice of the preferred embodiment.

FIG. 3 shows examples of alternative ways to mark dice with suit and numerical attributes.

DESCRIPTION—INTRODUCTION

The following describes the essence of my invention: how each of five top ranked numerical attributes in association with each of four suit attributes, twenty combinations in all, are arranged with four faces of each of five dice, a total of twenty faces, so that representations of every straight flush poker hand as well as hands containing four of every numerical attribute can be thrown.

Then criteria for marking lower ranking numerical attributes and associated suit attributes on the remaining ten faces is described. The method preserves the potential (a) to throw straight flushes encompassing the added representations of playing cards and (b) to throw hands containing four of each of the added numerical attributes.

DESCRIPTION—NOMENCLATURE

For clarity, the following description assumes the top ranking numerical attributes are called "ace", "king", "queen", "jack", "ten", "nine", "eight" and "seven" and are represented respectively by the symbols "A", "K", "Q", "J", "10", "9", "8" and "7". The ace corresponds to the highest ranking numerical attribute, and the seven the lowest.

The invention applies equally well to suit and numerical attribute markings different than those assumed above. In various international markets, an "R" might be used in place of the "K", a "D" in place of the "Q", and a "V" or "B" in place of the "J", as just a few examples.

For purposes of the following description, the well-known suits called spades, hearts, diamonds, and clubs are used. They are represented respectively by the symbols ♠, ♥, ♦, and ♣. Clearly, my invention applies equally well to any other marking and coloring convention used to distinguish four suit attributes.

In poker and other playing card games, certain cards with special indicia are called wild cards or "jokers". Game players may by mutual agreement use such cards to represent any other card in the playing deck at the holder's option. Such special cards have an analog in poker dice. They are also called "jokers" here and are so represented in the drawings.

DESCRIPTION—ARRANGEMENT OF TWENTY CARD INDICIA ON FIVE DICE

Using the above representations of suits and numerical attributes, the objects will be attained as follows. There are five different combinations of four of the five top ranked numerical attributes A, K, Q, J, 10. Four faces on each of five dice are marked with one of the combinations according to the following table.

| | Die 1 | Die 2 | Die 3 | Die 4 | Die 5 |
|---|---|---|---|---|---|
| Face 1 | A | A | A | A | K |
| Face 2 | K | K | K | Q | Q |
| Face 3 | Q | Q | J | J | J |
| Face 4 | J | 10 | 10 | 10 | 10 |
| Face 5 | Un-specified | Un-specified | Un-specified | Un-specified | Un-specified |
| Face 6 | Un-specified | Un-specified | Un-specified | Un-specified | Un-specified |

The assignment of identifying numbers to the five dice and their faces is arbitrary.

This manner of distributing numerical attributes across the dice is unique. Any other arrangement will not enable the user to throw both the top ranked straight flushes and four of any kind with the same dice, regardless of how the suits are marked on the dice.

The suits, on the other hand, can be marked on the twenty faces in several ways. Specifically, the twenty die faces marked with numerical attributes as specified above must be marked with suit attributes according to the following criteria:

Each combination of one of the four suits and one of the five top ranked numerical attributes is marked only once on the twenty faces, and Each of the four suit attributes is marked exactly once on each die.

There are 1,344 ways in which the twenty faces can be marked according to these rules. One such way is shown in the following table.

| | Die 1 | Die 2 | Die 3 | Die 4 | Die 5 |
|---|---|---|---|---|---|
| Face 1 | A ♠ | A ♥ | A ♦ | A ♣ | K ♠ |
| Face 2 | K ♥ | K ♦ | K ♣ | Q ♠ | Q ♥ |
| Face 3 | Q ♦ | Q ♣ | J ♠ | J ♥ | J ♦ |
| Face 4 | J ♣ | 10 ♠ | 10 ♥ | 10 ♦ | 10 ♣ |
| Face 5 | Un-specified | Un-specified | Un-specified | Un-specified | Un-specified |
| Face 6 | Un-specified | Un-specified | Un-specified | Un-specified | Un-specified |

My invention covers this and the 1,333 other possible face markings that meet the above criteria.

Inspection of this arrangement of markings shows that the user of such dice can throw all four straight flushes as well as hands containing all four of any numerical attribute marked on the dice.

Description—Markings on Remaining Ten Faces

If markings for the sixth ranked numerical attribute appear on any of the remaining ten faces, they shall satisfy the following criteria:

The markings of a sixth ranked numerical attribute and associated suit attribute shall be on the same die as bears the top marked numerical attribute of the same suit. For example, the 9♠ must be on the same die that bears the A♠.

Each combination of suit and numerical attributes shall be marked not more than once on all faces of all five dice.

Similarly, any markings for the seventh ranked numerical attribute must satisfy the following criteria:

The markings of a seventh ranked numerical attribute and associated suit attribute shall be on the same die as bears the second ranked numerical attribute of the same suit. For example, the 8♦ must be on the same die that bears the K♦.

Each combination of suit and numerical attributes shall be marked not more than once on all faces of all five dice.

Satisfaction of these criteria preserves the essential properties of my dice invention: that all possible straight flushes and fours of any kind marked on the dice can be thrown.

If four nines and four eights are marked on the dice, two faces remain unspecified. In a specific embodiment, these faces can be arbitrarily marked. For example, they may be marked with advertising or promotional material or they may be marked as jokers.

The eighth ranked numerical attribute, the seven, may also be marked on the two faces. If the two faces are marked with sevens, then the following criteria must be met:

The markings of an eighth ranked numerical attribute and associated suit attribute shall be on the same die as bears the third ranked numerical attribute of the same suit. For example, the 7♥ must be on the same die that bears the Q♥.

Each combination of suit and numerical attributes shall be marked not more than once on all faces of all five dice.

These criteria are necessary to preserve the capability of the dice to produce all possible straight flushes involving the sevens.

Description—Preferred Embodiment

In the preferred embodiment, five dice 1, 2, 3, 4 and 5 are marked with numerical and suit attributes as shown in perspective view in FIG. 1. All combinations of the top ranked seven numerical attributes, represented by A through 8. and the four suits, marked using the symbols ♠, ♥, ♦ and ♣, are arranged on five six-sided dice according to the criteria specified in the preceding description, as shown in FIG. 2A through FIG. 2E.

Six sides 11 through 16 are on die 1 and are marked with A♠, K♥, Q♦, J♣, 9♠ and 8♥. Sides 21 through 26 are on die 2; sides 31 through 36 are on die 3; sides 41 through 46 are on die 4; and sides 51 through 56 are on die 5.

On every die, the face markings may be arbitrarily distributed among the six faces of the die and may also arbitrarily oriented.

In the preferred embodiment, two faces, 46 and 56 are marked as jokers but could carry suit and numerical attribute markings such as 7♠ and 7♥.

The perspective view depicts the five dice showing a straight flush consisting of A♠ on side 11 of die 1, K♠ on side 51 of die 5, Q♠ on side 42 of die 4, J♠ on side 33 of die 3, and 10♠ on side 24 of die 2.

Inspection of FIGS. 2A through 2E reveals that every face marked with a suit attribute can be potentially rolled in a straight flush without resort to using the jokers. For example, a straight flush in clubs with an eight as the lowest ranked numerical attribute can be rolled with the Q♣ on side 23, J♣ on side 14, 10♣ on side 54, 9♣ on side 45 and 8♣ on side 36.

For every face marked with suit and numerical attributes, it is possible to throw a four-of-a-kind poker hand comprising that face and three others marked with the same numerical attribute and the remaining three suit attributes. For example, every die face with a queen marked would be part of the throw showing Q♦ on side 13 of die 1, Q♣ on side 23 of die 2, Q♠ on side 42 of die 4, Q ♥ on side 52 of die 5, and any one of six faces 31 through 36 on die 3.

DESCRIPTION-PERFORMANCE OF THE DICE

Dice marked according to the preferred embodiment set out in FIG. 2A through FIG. 2E will yield 7,776 different hands. Hands in all the usual poker categories can be thrown with the dice without using jokers as shown in the following table.

| Hand Category | Example | | | | |
|---|---|---|---|---|---|
| Straight Flush | A ♠ | K ♠ | Q ♠ | J ♠ | 10 ♠ |
| Four Of A Kind | A ♠ | A ♥ | A ♦ | A ♣ | K ♠ |
| Full House | J ♥ | J ♦ | J ♣ | 10 ♠ | 10 ♥ |
| Flush | A ♦ | Q ♦ | J ♦ | 10 ♦ | 8 ♦ |
| Straight | A ♣ | K ♥ | Q ♣ | J ♦ | 10 ♥ |
| Three Of A Kind | 10 ♠ | 10 ♦ | 10 ♣ | K ♣ | Q ♦ |
| Two Pair | K ♥ | K ♦ | J ♠ | J ♦ | A ♣ |
| Pair | 8 ♦ | 8 ♣ | Q ♠ | J ♣ | 10 ♣ |
| None Of Above | A ♣ | K ♣ | J ♣ | 10 ♠ | 8 ♠ |

From this table it is apparent that dice of my invention are superior to classical poker dice because mine are capable of showing a richer variety of poker hands. Poker hands which are defined in terms of suits, such as royal flushes, straight flushes and flushes can be achieved with my dice. Classical poker dice cannot produce such hands.

The entertainment value of the preferred embodiment of my dice, defined by the relative frequency of throwing a hand ranking above a pair, is 27.2 percent, ignoring jokers. That is superior to dice with more than six sides, the best of which achieve only 18.5 percent with dice disclosed in U.S. Pat. No. 4,989,875 to Capy (1991).

It is apparent that all possible straight flushes which are to be found among the aggregate of the face markings of dice of my invention are capable of being thrown with the dice, without the use of jokers as wild cards. Further, hands containing four of any kind of numerical attribute marked on the dice can be thrown, again without the use of jokers.

Finally, it apparent that this superior performance is achievable on familiar but elegantly simple six-sided dice.

Beyond market appeal, the six-sided dice are advantageous because they are less expensive to manufacture. Their rectilinear shape makes them easy to fabricate. Further, cubical dice are already widely produced for other purposes.

RAMIFICATIONS AND SCOPE

Although the description above contains many specificities, these should not be construed as limiting the scope of the invention but as merely providing illustrations of some of the presently preferred embodiments of this invention.

For example, the performance of my invention is independent of the specific symbols or method used to indicate suit and numeric attributes. In particular, some markings combine both suit and numerical attributes into one symbols or set of symbols. An illustration is a set of ten "♥" symbols which indicate the numerical attribute "10" and the suit "hearts". Examples of alternative markings are shown in FIG. 3.

As another example, die faces marked with a joker may bear instead numeric and suit attribute markings or arbitrary promotional material.

Thus the scope of the invention should be determined by the appended claims and their legal equivalents, rather than by the examples given.

I claim:

1. A set of five game dice, each die having six faces, some of which marked with numerical attributes selected from a range of at least five numerical attributes of ascending rank and suit attributes selected from a set of four suit attributes so that:

- each combination of a suit attribute and a numerical attribute is marked on no more than one face of said dice;
- every face of said dice is marked with no more than one numerical attribute and no more than one suit attribute;
- every face of said dice that is marked with a numerical attribute is also marked with a suit attribute and vice versa;
- each of said five dice has marked on four of its said faces exactly one of the five unique combinations of four of the five top-ranked numerical attributes, so that every one of said combinations of numerical attributes is marked on the faces of some one of said dice;
- all four suit attributes are marked on every set of four faces that is marked with one of said combinations of numerical attributes;
- any die having a face marked with a sixth-ranked numerical attribute along with a suit attribute has also a face marked with the same suit attribute and the top-ranked numerical attribute;
- any die having a face marked with a seventh-ranked numerical attribute along with a suit attribute has also a face marked with the same suit attribute and the second-ranked numerical attribute; and
- any die having a face marked with an eighth-ranked numerical attribute along with a suit attribute has also a face marked with the same suit attribute and the third-ranked numerical attribute;
- to permit throwing, at a minimum, representations of poker hands known as: a straight flush, represented by five faces, one per die, marked with five consecutively ranked numerical attributes, all associated with the same suit attribute; and four of a kind, represented by four faces, one per die, marked with the same numerical attribute and the four different suit attributes.

2. A set of game dice according to claim 1, characterized in that some markings combine numerical and suit attributes, such as a numerical attribute represented by a multiplicity of suit attribute symbols on a single face, the cardinal number of said multitude being the same as the ordinal number of the numerical attribute.

* * * * *